United States Patent [19]

Nissels

[11] Patent Number: 4,838,490

[45] Date of Patent: Jun. 13, 1989

[54] ROTATABLE NOZZLE ASSEMBLY FOR SPRAYERS

[75] Inventor: Robert Nissels, Saint-Georges de Reneins, France

[73] Assignee: Berthoud S.A., Belleville-sur-Saone, France

[21] Appl. No.: 169,235

[22] Filed: Mar. 16, 1988

[30] Foreign Application Priority Data

Mar. 26, 1987 [FR] France ..... 87 04444

[51] Int. Cl.[4] ..... B05B 9/043

[52] U.S. Cl. ..... 239/333; 239/394; 239/396

[58] Field of Search ..... 239/390, 394, 396, 331, 239/333

[56] References Cited

U.S. PATENT DOCUMENTS

| | | | |
|---|---|---|---|
| 155,852 | 10/1874 | Bowen | 239/394 |
| 1,964,807 | 7/1934 | Baum | 239/394 |
| 2,162,057 | 6/1939 | Brandt et al. | 239/394 |
| 2,576,947 | 12/1951 | Larson | 239/333 |
| 3,291,395 | 12/1966 | Sharp | 239/394 |
| 3,514,017 | 5/1970 | Malone | 239/333 |
| 3,596,835 | 8/1971 | Smith | 239/394 |
| 3,704,831 | 12/1972 | Clark | 239/394 |
| 3,940,069 | 2/1976 | Gunzel, Jr. | 239/396 |
| 4,247,048 | 1/1981 | Hayes | 239/396 |
| 4,534,512 | 8/1985 | Chow et al. | 239/394 |

*Primary Examiner*—Andres Kashnikow
*Assistant Examiner*—Michael J. Forman
*Attorney, Agent, or Firm*—Dowell & Dowell

[57] ABSTRACT

A rotatable nozzle assembly for sprayers having a fluid reservoir and spray head wherein the nozzle assembly includes a spray control barrel which receives liquid from the reservoir and which includes a number of annular spaced orifices. The barrel is rotatably mounted in eccentric relationship within a tube portion of the spray head which is closed by a cap having a discharge opening therein so that the orifices in the barrel may be selectively aligned with the discharge opening in the cap to thereby vary the spray pattern discharging from the sprayer.

15 Claims, 3 Drawing Sheets

ROTATABLE NOZZLE ASSEMBLY FOR SPRAYERS

BACKGROUND OF THE INVENTION

1. Field of the Invention

The present invention relates to improvements in or relating to sprayers, particularly for spraying plant-protective liquids, and it concerns more particularly sprayers which may be held in the hand and which have adjustable nozzles to permit selective spray patterns.

2. Description of the Related Art

Correct spraying must comply with two principal conditions: first, the spray jet must be perfectly adapted to the treatment or application required and second, the spray must be consistant. Therefore, it is preferable to use a sprayer with a maintained or constant pressure accumulator.

Most apparatus which function in the above manner are well known in practice as "back" apparatus, i.e. those borne on the shoulder or on the back. On the other hand, such spraying capabilities are not encountered in small sprayers held in the user's hand.

SUMMARY OF THE INVENTION

It is an object of the improvements according to the present invention to enable a sprayer to be produced comprising a plurality of outlet nozzles which are associated with a barrel which the user can easily rotate in order to select the desired spray pattern.

To that end, the sprayer according to the invention is provided with a selectively rotatable barrel forming a spray nozzle having a plurality of orifices formed therein. The barrel is mounted within a tube around a geometrical axis eccentric with respect to the elongated axis of the tube. The barrel is surrounded by a cap having a central hole through which the sprayed liquid may pass when one of the orifices of the spray nozzle is in alignment with the geometrical axis of the tube. A lateral channel conducts the liquid under pressure to that orifice which has been selectively aligned opposite the central hole of the cap.

According to a preferred embodiment, a pressurized liquid retention chamber is in communication with one of the spray orifices by way of an opening valve, the liquid being sent into this chamber by a lifting and forcing pump from a fluid reservoir, with the result that the chamber constitutes a pressure accumulator maintaining a pressure on the liquid therein.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
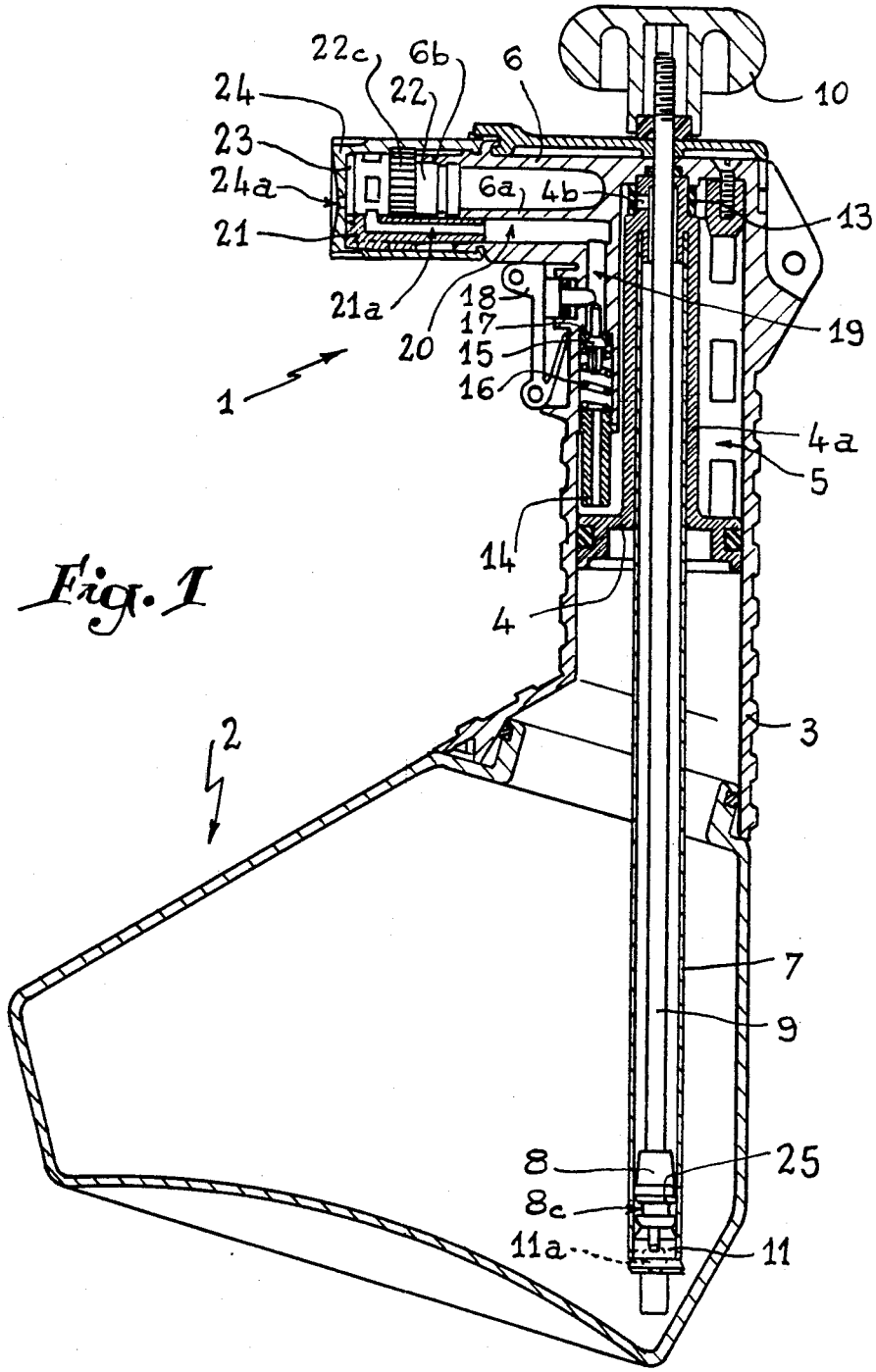
FIG. 1 is a longitudinal section through a hand sprayer improved in accordance with the invention.

Referring now to the drawings, the spray appliance illustrated in FIG. 1 essentially comprises a spray head 1 associated with a reservoir 2. The reservoir is secured at its upper end to a wide opening at the base of the head

1 which is generally in the form of an elbow. The first portion of this elbow, which is oriented vertically is in the form of a tubular outer sleeve 3 in which is disposed an inner sleeve 4*a* having a bottom 4 intended to seal against the outer sleeve to thereby define a closed chamber 5 intermediate the inner and outer sleeves. The inner sleeve 4*a* which passes vertically through the chamber 5 is fixed by any appropriate means to the upper end of the sleeve 3 which is associated with a tube 6 which constitutes the second portion of the head 1. Inside the inner sleeve 4*a* is disposed a tube 7 which forms the cylinder of a lifting and forcing pump of which the piston 8 is located at the end of a rod 9 passing through the inner sleeve 4*a* and emerging from the tube 6 where an actuating handle 10 is mounted.

The bottom of the tube 7 is provided with a non-return valve 11, while the space included between the tube and the rod 9 communicates with the chamber 5 by a radial hole 4*b* opening out on the periphery of an end bearing surface of the inner sleeve 4*a* and which hole is surrounded by an elastic ring 13 which forms the delivery valve of the pump.

Inside the chamber 5 is a perforated plunger 14 above which is located a valve 15 loaded by a spring 16 and which closes the outlet orifice 17 of the chamber 5. A trigger 18 makes it possible to lower the valve 15 against the spring when desired to effect spraying.

Figure 2:
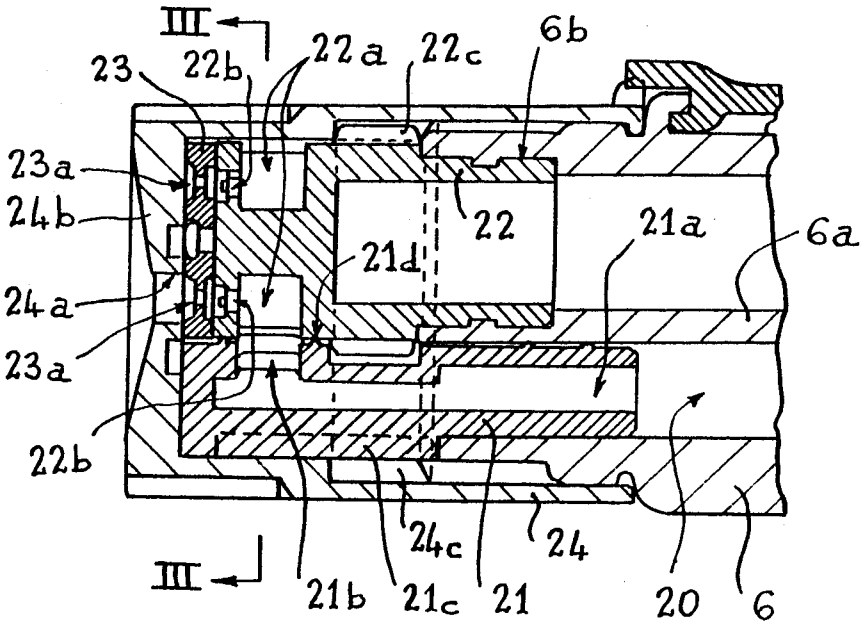
FIG. 2 is an enlarged view in detail illustrating ion particular the barrel forming the multiple spray nozzle.
Figure 3:
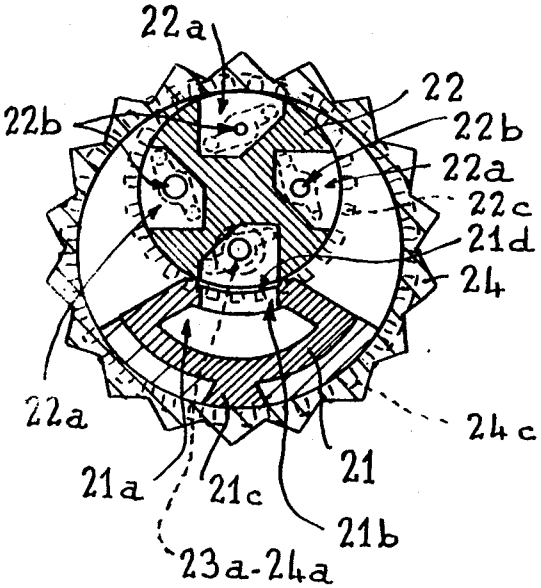
FIG. 3 is a section along III—III (FIG. 2).

The orifice 17 of chamber 5 lies in a perforation or channel 19 in the sleeve 3 made longitudinally therein and which opens out into a lateral channel 20 made in tube 6. In this channel is mounted an added piece or support shoe 21 which includes a longitudinal perforation 21*a* which communicates with the channel 20 and terminates in opening 21*b* oriented radially in the direction of the center axis of the tube 6 (FIG. 2). The support shoe 21 is provded with a dove-tailed heel or base 21*c* which engages in a groove of the same shape made in the tube 6. A part of the shoe 21 projects beyond the tube 6 and is provided with a concave face 21*d*. Inside the tube 6 is a tubular partition 6*a* which is hollowed, like the corresponding part of the tube 6, to form a bearing surface 6*b* in which is engaged a barrel 22 of which the front part is cooperatively seated on the face 21*d* of the show 21. The geometrical elongated axis of the barrel is thus offset or eccentric with respect to the axis of the tube. Four identical depressions 22*a* are hollowed out in the peripheral part of the barrel 22 located opposite the face 21*d* and the center of each of these depressions is provided with a hole 22*b*. As illustrated in the drawing, when liquid arrives via channel 21*a* and radial openings 21*b*, it passes into one of the depressions 22*a* and leaves through its hole 22*b*. A washer 23 is assembled at the front of the barrel 22 and includes four openings 23*a* located opposite each of the holes 22*b* in the barrel 22. The washer 23 is held on the barrel 22 so that the liquid leaving any opening of the latter passes entirely through the corresponding openings 23*a* in the washer. The openings 23*a* are arranged so that they are all different and make it possible to produce a non-wetting hollow conical jet (mist), a wetting hollow conical jet, a conical jet for remote treatment and a straight jet. The geometrical axis of the tube 6 is arranged to pass through the opening 23*a* of the washer 23 when such opening lies opposite the hole 24*a* made at the center of the transverse end wall 24*b* of a cap 24 surrounding the end of tube 6. The cap is located on the geometrical axis of the tube. The interior of this cap is provided with inner teeth 24c which cooperate with the teeth of a ring 22c made on the periphery of the barrel 22. In this way, by rotating the cap 24, the barrel is rotated in order to bring the desired orifice or hole 22b opposite spray hole 24a. Indications are given on the cap so that the user can place opposite the hole 24a the desired nozzle with each nozzle being defined by the combination of an opening 23a and a hole 22b.

Figure 5:
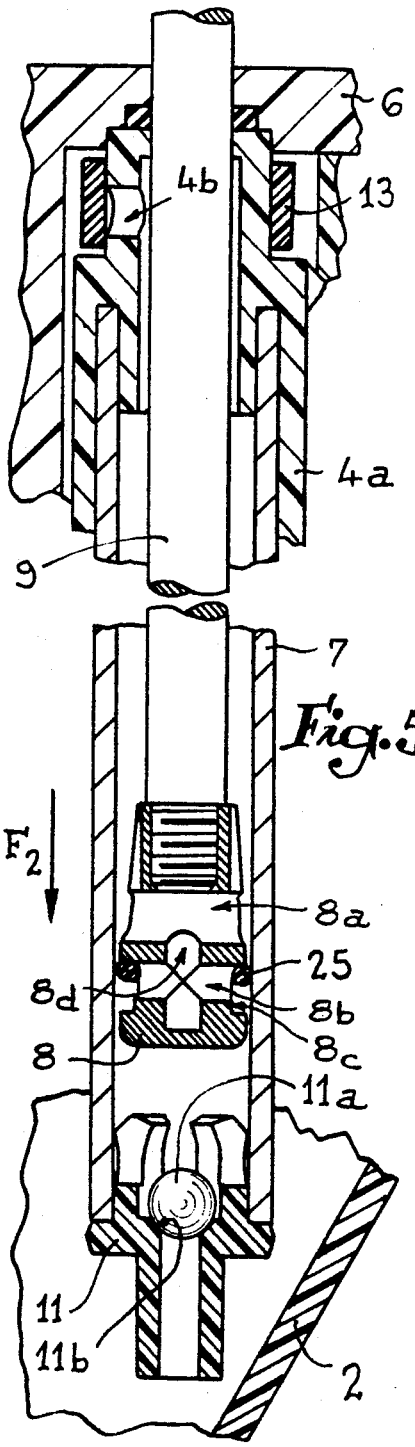
FIGS. 4 and 5 are longitudinal sections of the pump for operating the sprayer according to the invention.
Figure 4:
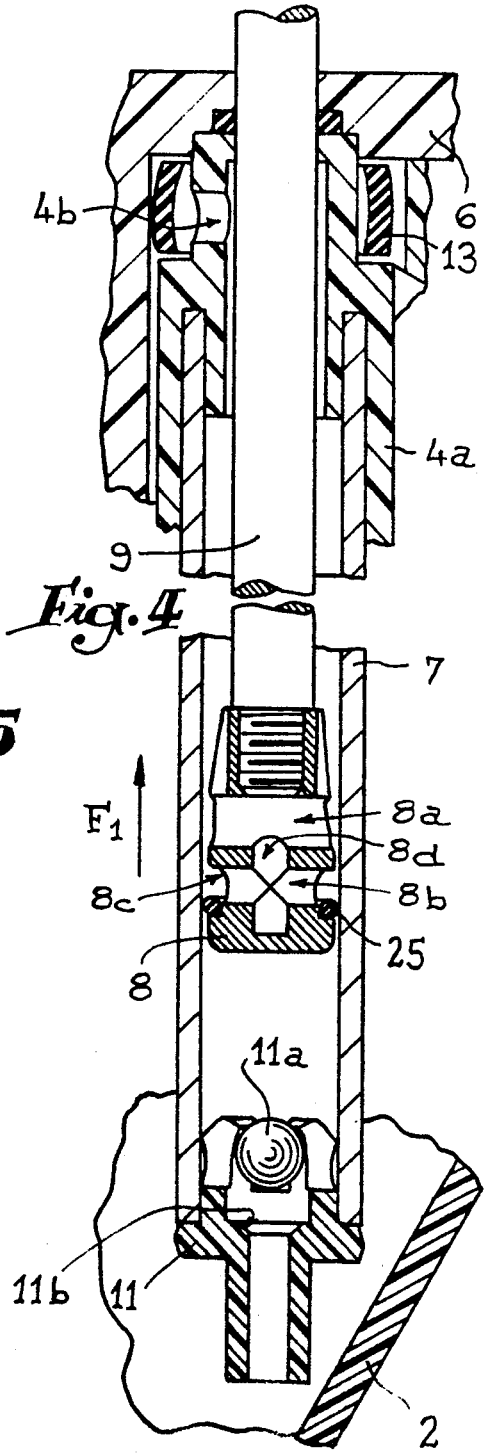

As illustrated in FIGS. 4 and 5, the piston 8 disposed at the base of the rod 9 comprises two transverse holes 8a, 8b of which hole 8b opens out via its two ends into a groove 8c. The two holes 8a and 8b communicate via an axial conduit 8d. An O-ring 25 is engaged in the groove 8c of the piston whose width is very clearly greater than the diameter of the seal. In this way, when the rod 9 is moved in the direction of arrow F1 in FIG. 4, a seal is created between the piston 8 and the tube 7 at the bottom of the groove and the liquid located in the reservoir 2 is sucked upwardly as the ball 11a of the valve 11 lifts from its seat 11b. The interior of the tube 7 is thus filled with liquid when the piston arrives at its top dead center.

On the contrary, when the rod is descended, as illustrated in FIG. 5, in the direction of arrow F2, the seal moves in the groove 8c with the result that it is placed so that the hole 8b is in communication with the compartment of the cylinder located below the piston. The downward displacement causes passage of the liquid through the hole 8b then into conduit 8c and finally through hole 8a, with the result that the liquid rises above the piston in the annular space between the rod 9 and the tube 7. In the subsequent operation of raising the piston, a seal is effected between the piston and the compartment of the cylinder located below this piston as described hereinabove with reference to FIG. 4, with the result that, in addition to the operation of suction, the liquid is delivered into chamber 5, passing through orifice 4b as the ring 13 is forced outwardly. The chamber 5 performs the role of accumulator in which the liquid accumulates under pressure, with the result that it suffices to press on the trigger 18 to initiate spraying. The dimensions of the different elements composing the sprayer according to the invention have been calculated so that it is ready to operate with two pumpings of the rod 9 by way of handle 10, regardless of the quantity of liquid present in the reservoir. It should be emphasized that this sprayer may also be used with maintained pressure without the pressure accumulator by pumping constantly while maintining the outlet valve open by manipulation of trigger 18.

It must, moreover, be understood that the foregoing description has been given only by way of example and that it in no way limits the domain of the invention which would not be exceeded by replacing the details of execution described by any other equivalents.

I claim:

1. A sprayer apparatus comprising a liquid reservoir and a dispenser head, said dispensing head having first and second portions, said first portion of said dispensing head being mounted to said liquid reservoir, said second portion of said dispensing head including a tube means having an elongated axis, a liquid passageway extending along said tube means, valve means for introducing liquid under pressure into said liquid passageway, a nozzle barrel rotatably mounted within said tube means in eccentric relationship with said elongated axis thereof, said nozzle barrel including an outer end portion which extends outwardly of said tube means, at least two annularly sapced orifices provided through said outer end portion of said nozzle barrel, at least two spaced depressions formed in said outer end portion of said nozzle barrel so as to be in communication with one of each of said at least two orifices and for selectively communicating said orifices with said liquid passageway, a cap means mounted about said nozzle barrel and having an outer end spaced from said tube means, said cap means having a discharge opening in said outer end thereof which is aligned with the axis of said tube means, each of said orifices being spaced so as to be selectively and separately alignable and in open communication with said discharge opening in said cap means as said nozzle barrel is rotated relative to said tube means.

2. The sprayer apparatus of claim 1 in which said nozzle barrel includes an outer peripheral portion having a plurality of first teeth extending outwardly therefrom, said cap means having an inner body portion having a plurality of second teeth extending inwardly therefrom, said first and second teeth being engageable with respect to one another whereby as said cap means is rotated, said second teeth will engage said first teeth to thereby rotate said nozzle barrel to selectively align one of said orifices with said discharge opening.

3. The sprayer apparatus of claim 1 in which said nozzle barrel includes an inner end portion spaced from said outer end portion thereof, a tubular partition means formed in said tube means and having inner surface portions defining a bearing surface, said inner portion of said nozzle barrel being rotatably mounted within said bearing surface of said tubular partition means of said tube means.

4. The sprayer apparatus of claim 3 including a support means mounted within said fluid passageway of said tube means, said support means having an outer end portion including a concave support face, said outer end portion of said nozzle barrel being rotatably supported on said concave face of said support means.

5. The sprayer apparatus of claim 4 in which said fluid passageway includes a liquid flow channel through said support means and extending generally perpendicular to the axis of said tube means and an outlet opening extending from said channel radially inwardly toward said depressions in said nozzle barrel.

6. The sprayer apparatus of claim 1 including a spray shaping means disposed adjacent said outer end portion of said nozzle barrel, said spray shaping means including at least two openings therethrough, each of said openings being aligned with a different one of said orifices and being of different configuration whereby liquid sprays passing therethrough said orifices and an aligned opening will have a varied spray pattern.

7. The sprayer apparatus of claim 1 wherein said first portion of said dispensing head includes a liquid accumulation chamber wherein liquid is maintained under pressure, a pump means carried by said first portion of said dispensing head and extending within said fluid reservoir, and outlet valve means for communicating said pump means with said accumulation chamber whereby liquid from said liquid reservoir may be introduced into said accumulation chamber under pressure through said valve means.

8. The sprayer apparatus of claim 7 in which said accumulation chamber is formed intermediate an inner sleeve means and an outer sleeve means and said outlet valve means including an opening disposed between said inner sleeve means and said accumulation chamber.

9. The sprayer apparatus of claim 8 in which said pump means includes an elongated tube means which extends upwardly through said inner sleeve means so as to be in communication with said opening in said outlet valve means, a plunger rod means extending within said elongated tube means and having upper and lower ends, a piston means carried by said lower end of said rod means for drawing liquid into said tube means and a handle means extending outwardly of said dispensing head means for connection to said upper end of said rod means whereby said rod means may be operated by manipulation of said handle means.

10. The sprayer apparatus of claim 9 in which said outlet valve means includes an annular resilient band normally seated against said opening in said inner annular sleeve.

11. The sprayer apparatus of claim 9 wherein said piston means of said pump comprises first and second transverse openings therethrough which are oriented generally perpendicular with respect to said rod means, a radial groove formed in said piston means and communicating with one of said transverse openings, an O-ring slideably carried within said peripheral groove so as to be shiftable longitudinally with respect to said rod means, an axial opening in said piston means for communicating with said first and second transverse openings therein, and intake valve means disposed along the lower portion of said elongated tube means for allowing liquid to enter said elongated tube means as said piston means is raised with respect to said intake valve means.

12. An adustable sprayer nozzle for use with spraying apparatus having a source of liquid supply comprising a dispensing head including a tube means having an elongated axis, a liquid passageway extending along said tube means, valve means for introducing liquid under pressure from the liquid supply into said liquid passageway, a nozzle barrel rotatably mounted within said tube means in eccentric relationship with said elongated axis thereof, said nozzle barrel including an outer end portion which extends outwardly of said tube means, a number of annularly spaced spray orifices provided through said outer end portion of said nozzle barrel, a number of spaced depressions formed in said outer end portion of said nozzle barrel so as to be in communication with one of each of said orifices and for selectively communicating said spray orifices with said liquid passageway as said nozzle barrel is rotated relative to said tube means, each of said spray orifices having a different opening configuration so as to vary the liquid spray therethrough, a cap means mounted about said nozzle barrel and having an outer end spaced from said tube means, said cap means having a discharge opening in said outer end thereof which is aligned with the axis of said tube means, each of said spray orifices being spaced so as to be selectively and separately alignable and in open communication with said discharge opening in said cap means as said nozzle barrel is rotated relative to said tube means.

13. The adjustable sprayer nozzle of claim 12 including a support means mounted within said fluid passageway of said tube means, said support means having an outer end portion including a concave support face, said outer end portion of said nozzle barrel being rotatably supported on said concave support face of said support means.

14. The adjustable sprayer nozzle of claim 13 in which said nozzle barrel includes an outer peripheral portion having a plurality of first teeth extending outwardly therefrom, said cap means having an inner body portion having a plurality of second teeth extending inwardly therefrom, said first and second teeth being engageable with respect to one another whereby as said cap means is rotated, said second teeth will engage said first teeth to thereby rotate said nozzle barrel to selectively align one of said spray orifices with said discharge opening.

15. The adjustable sprayer nozzle of claim 13 in which said fluid passageway includes a channel which extends radially inwardly toward said depressions in said nozzle barrel.

* * * * *